US005730407A

United States Patent [19]

Ostrobrod

[11] Patent Number: 5,730,407

[45] Date of Patent: Mar. 24, 1998

[54] ROOF ANCHORING SYSTEM WITH A SAFETY LINE

[76] Inventor: Meyer Ostrobrod, 2070 Bennett Rd., Philadelphia, Pa. 19116

[21] Appl. No.: 509,269

[22] Filed: Jul. 31, 1995

[51] Int. Cl.[6] ..... A62B 1/08; A62B 1/16

[52] U.S. Cl. ..... 248/237; 248/228.5; 182/231; 182/3

[58] Field of Search ..... 248/237, 499, 248/228.1, 228.3, 228.5, 74.4, 226.11; 182/3, 4, 5, 45, 231, 232, 233, 234, 235, 236, 238, 239; 242/381.5, 396.6; 52/27, 37

[56] References Cited

U.S. PATENT DOCUMENTS

| | | | |
|---|---|---|---|
| 639,818 | 12/1899 | Levett | 242/396.6 |
| 878,679 | 2/1908 | Smith | 248/228.1 X |
| 928,010 | 7/1909 | Way | 248/228.5 X |
| 1,930,314 | 10/1933 | Healy et al. | 248/74.4 |
| 2,729,517 | 1/1956 | Hamilton, Sr. et al. | 304/20 |
| 3,889,911 | 6/1975 | Lindsey et al. | 248/228.1 |
| 4,249,713 | 2/1981 | Glynn et al. | 248/237 |
| 4,511,123 | 4/1985 | Ostrobrod . | |
| 4,607,724 | 8/1986 | Hillberg | 182/3 |
| 4,699,245 | 10/1987 | Benedet | 182/3 |
| 4,852,692 | 8/1989 | Flaherty | 182/231 |
| 4,877,110 | 10/1989 | Wolner | 182/232 |
| 4,942,943 | 7/1990 | Flaherty | 182/231 |
| 4,946,123 | 8/1990 | Albert | 248/237 |
| 5,011,106 | 4/1991 | Cody | 248/237 |
| 5,036,949 | 8/1991 | Crocker et al. | 182/3 |
| 5,054,576 | 10/1991 | Glynn | 182/3 |
| 5,092,426 | 3/1992 | Rhodes | 182/3 |
| 5,105,907 | 4/1992 | Lebow | 182/3 |
| 5,137,112 | 8/1992 | Nichols | 182/3 |
| 5,143,170 | 9/1992 | Hunt et al. | 182/3 |
| 5,143,171 | 9/1992 | Glynn et al. | 182/3 |
| 5,186,289 | 2/1993 | Wolner et al. | 182/232 X |
| 5,211,411 | 5/1993 | Oleksiuk | 182/45 X |
| 5,248,021 | 9/1993 | Nichols | 182/3 |
| 5,282,597 | 2/1994 | Babcock | 248/237 |
| 5,287,944 | 2/1994 | Woodyard | 182/3 |
| 5,320,193 | 6/1994 | Bongiovanni et al. | 182/3 |
| 5,320,194 | 6/1994 | Bredijk | 248/237 X |
| 5,361,558 | 11/1994 | Thornton et al. | 52/698 |
| 5,370,202 | 12/1994 | Nichols | 182/3 |

*Primary Examiner*—Ramon O. Ramirez
*Assistant Examiner*—Stephen S. Wentsler
*Attorney, Agent, or Firm*—Norman E. Lehrer

[57] ABSTRACT

A roof anchoring system for securing a safety winch assembly to a roof frame includes such a safety line winch assembly that has a housing with a drum and a drum shaft mounted therein. A safety line, which is adapted to be wrapped around the drum, has one end secured to the drum and an opposite end adapted to be connected to a workman. A centrifugal brake is also mounted within the housing for preventing rapid rotation of the drum and therefore rapid unwinding of the safety line. The roof anchor includes a plate member that has a plurality of holes formed therethrough. Screws are inserted through the holes and into the roof to secure the roof anchor to the roof frame. A base frame assembly supports the winch assembly thereon and has a plurality of wheels rotatably mounted to and extending downwardly from the base frame member. The base frame assembly is mounted for rotation about the roof anchor.

18 Claims, 6 Drawing Sheets

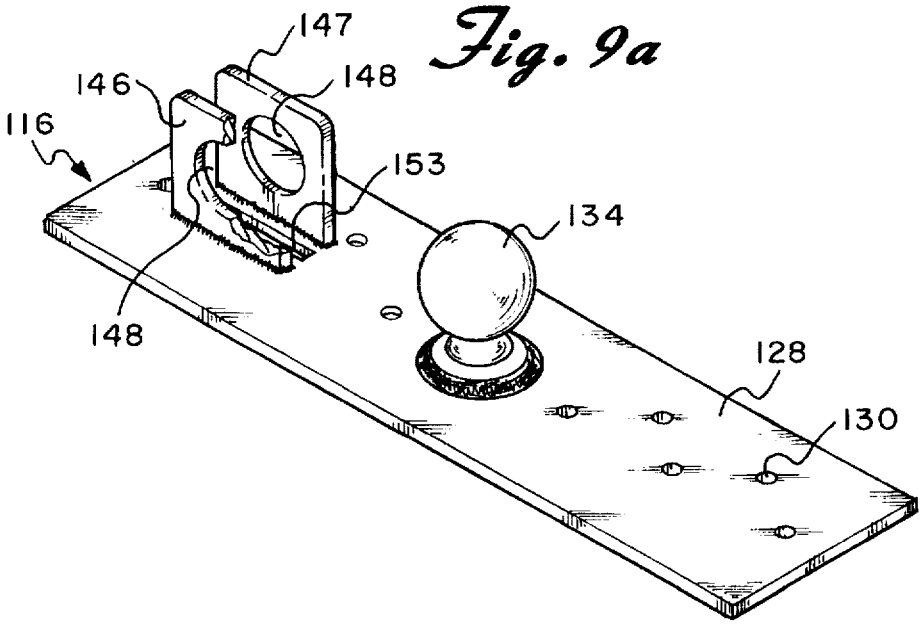
Fig. 9a
Fig. 10
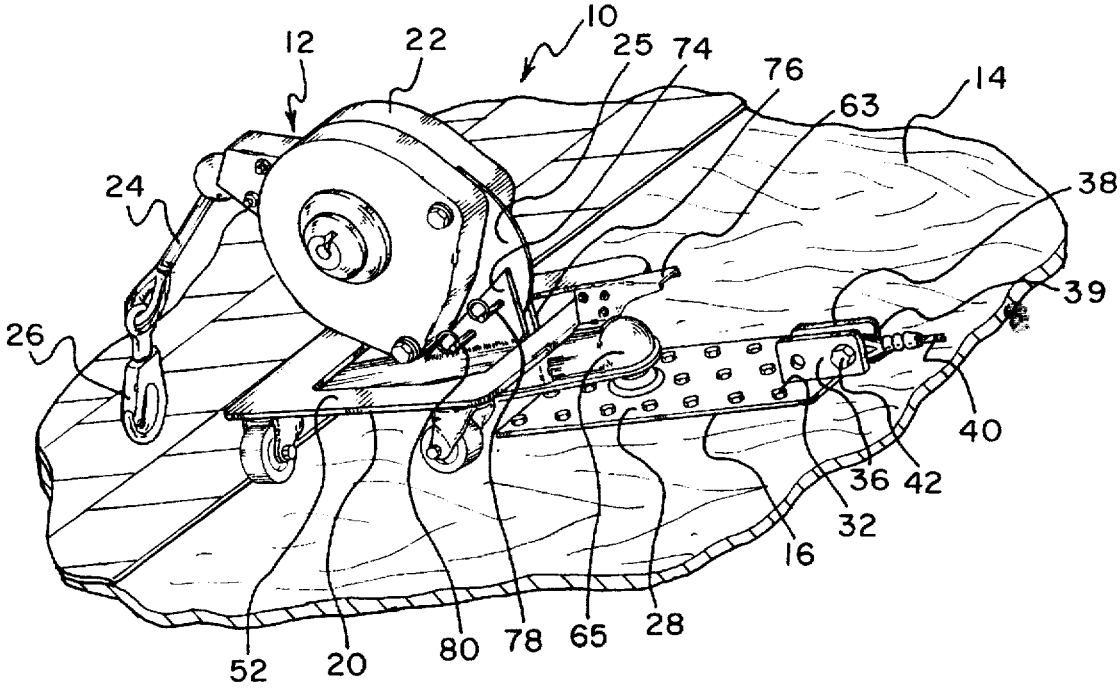

ROOF ANCHORING SYSTEM WITH A SAFETY LINE

BACKGROUND OF THE INVENTION

The present invention is directed toward a roof anchoring system for supporting a workman on a roof and, more particularly, to such an anchoring system that prevents the workman from accidentally falling from a pitched roof.

Presently, there are numerous devices in existence that are designed to prevent roofers from accidentally falling off roofs during the laying of shingles, construction, maintenance or other related activities. The demand for such devices has dramatically increased over the last few years as government regulations have been passed that require the use of fall prevention systems to ensure the safety of individuals working on roofs.

Heretofore, the preferred fall prevention systems typically consisted of lifelines having one end secured to a workman's harness or belt and an opposing end secured to some type of anchoring means. Most known anchoring means are deficient in that they cannot sufficiently withstand the significant forces created when a workman accidentally falls from a roof. Additionally, most existing roof anchors are not adapted to secure a workman's safety line to both sides of a pitched roof.

SUMMARY OF THE INVENTION

The present invention is designed to overcome the deficiencies of the prior art discussed above. It is an object of this invention to provide a roof anchoring system that allows a roofer to be safely tethered to the same.

It is a further object of the invention to provide such a system that complies with relevant governmental regulations.

It is yet another object to provide such a roof anchoring system that can be installed quickly and easily.

In accordance with the illustrative embodiments, demonstrating features and advantages of the present invention, there is provided in one embodiment a roof anchoring system for securing a safety winch assembly to a roof frame. The safety winch assembly is of the type that includes a housing that accommodates a drum, a rotatable drum shaft and a centrifugal brake. A safety line, which is adapted to be wrapped around the drum, has one end secured to the drum and an opposite end adapted to be connected to a workman's belt or harness. The roof anchor includes a plate member that is secured to the roof frame. A base frame supports the winch assembly and includes a plurality of wheels that extend downwardly from the base member. The base frame assembly is mounted for rotation about the roof anchor.

Other objects, features and advantages will be readily apparent from the following detailed description of preferred embodiments thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

FIG. 9*a* is a perspective view of a modified form of a single ball hitch roof anchor;

FIG. 10 is a perspective view of the ball hitch roof anchor of FIG. 7 with base frame and winch assemblies shown secured thereto;

DETAILED DESCRIPTION OF THE PREFERRED EMBODIMENT

Figure 1:
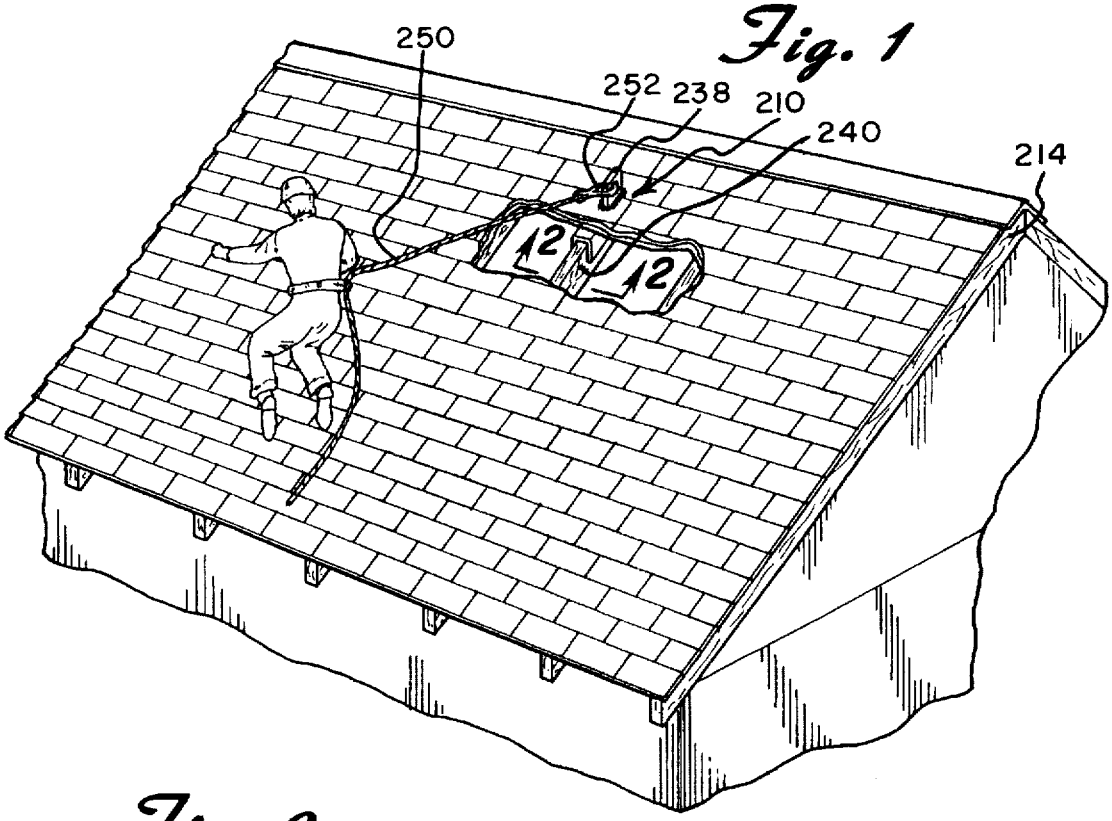
FIG. 1 is a perspective view of a roof anchoring system of the present invention shown attached to a roof.

Referring now to the drawings in detail wherein like reference numerals have been used throughout the various figures to designate like elements, there is shown in FIG. 10 a roof anchoring system for supporting a workman thereon constructed in accordance with the principles of the present invention and designated generally as 10.

The roof anchoring system 10 is adapted to secure a safety winch assembly 12 to a roof frame 14. The roof anchoring system 10 preferably includes two roof anchors 16 and 18 (see FIGS. 7 and 9) and a base frame assembly 20 for supporting the winch assembly 12 thereon.

Figure 11:
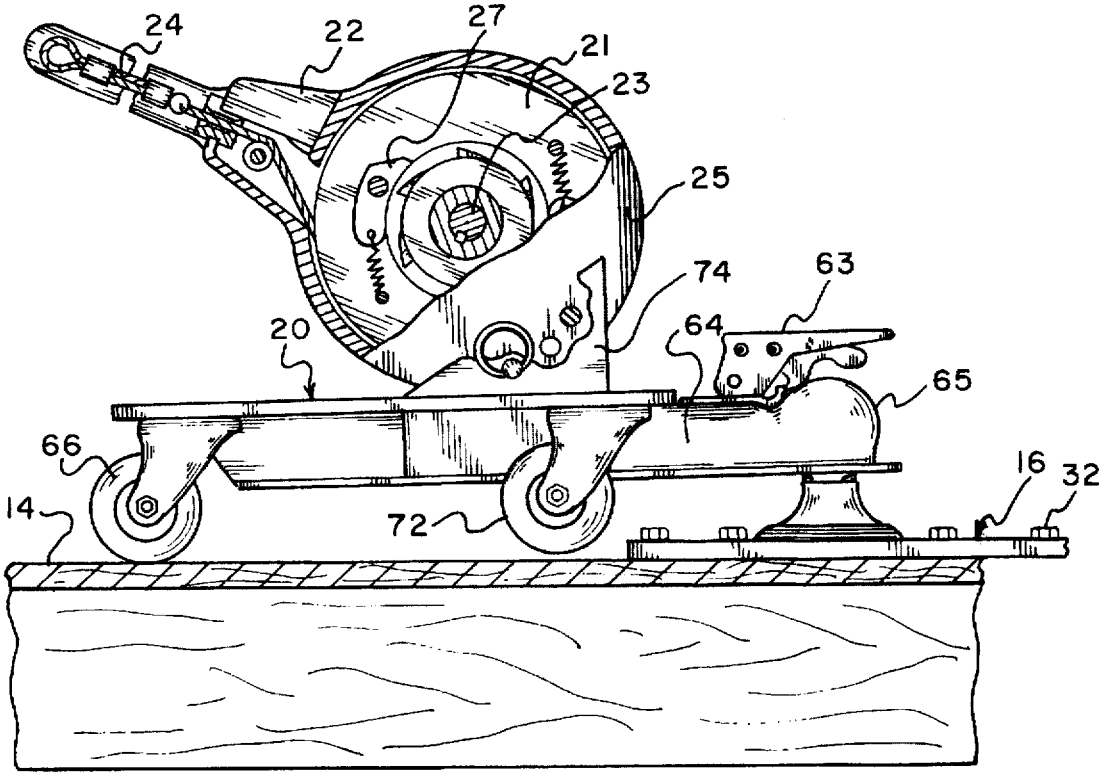
FIG. 11 is a partial side view of the ball hitch roof anchor and base frame assembly of FIG. 10.

The winch assembly is of the type generally known in the industry, as shown in U.S. Pat. No. 4,511,123, and includes a housing 22 with a drum 21 and a drum shaft 23 mounted therein as shown in FIG. 11. A safety line 24 is adapted to be wound around the drum and has one end secured thereto. The other end of the line 24 is adapted to be connected to a snap hook 26. A workman secures his belt or harness to the snap hook. A centrifugal brake means 27 is also mounted within the housing in order to prevent rapid rotation of the drum and therefore rapid unwinding of the safety line 24. A mounting plate 25 is secured to and extends from the winch assembly 12 for mounting the same to the base frame assembly 20 as more fully described below.

Figure 7:
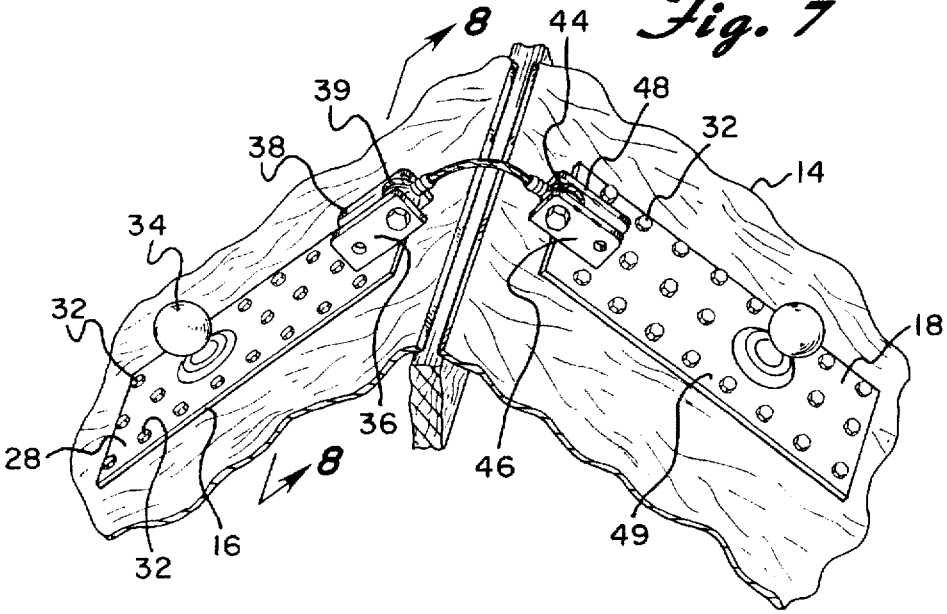
FIG. 7 is a perspective view of a pair of ball hitch roof anchors shown attached to a pitched roof.
Figure 9:
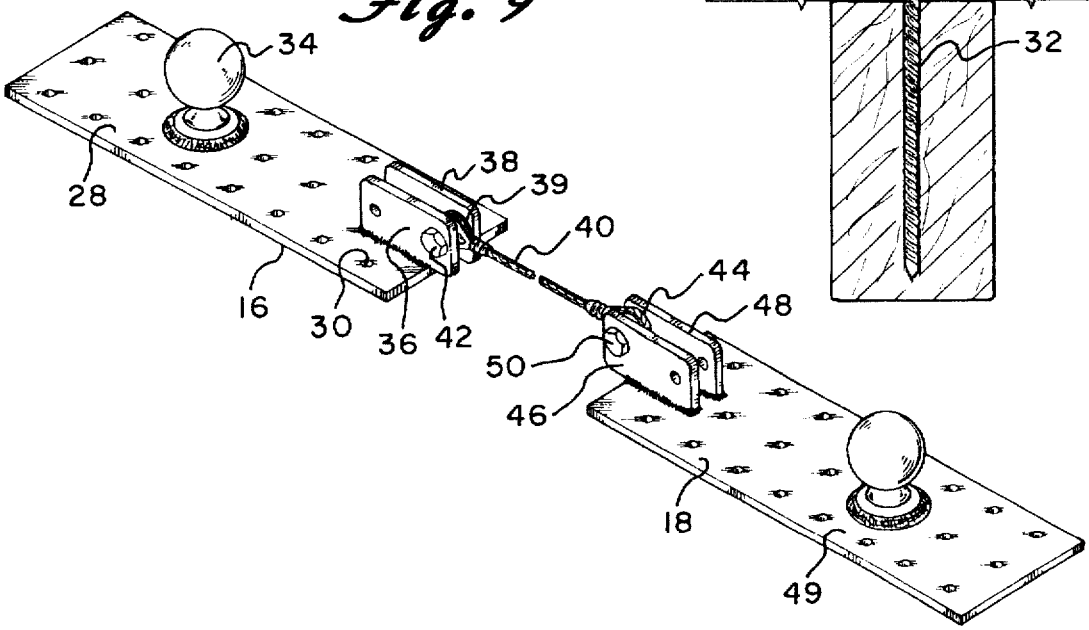
FIG. 9 is a perspective view of the roof anchors shown in FIG. 7.

Each of the roof anchors 16 and 18 is substantially identical to the other. Accordingly, only one of the anchors will be described in detail, it being understood that the description applies equally to the other roof anchor. Referring to FIGS. 7, 9 and 10, the roof anchor 16 includes a plate member 28. The plate member is preferably made of stainless steel. However, it can be made of other metal alloys or other materials. The plate member 28 has a plurality of holes 30 formed therethrough (see FIG. 9). In order to secure the plate member 28 to the roof frame 14, a plurality of screws 32 pass through each of the holes 30 in the plate member 28 and are threaded into the roof frame. Extending upwardly from the plate member 28 is a ball shaped member 34. The ball member facilitates the attachment of the base frame assembly 20 to the roof anchor as more fully described below.

Figure 8:
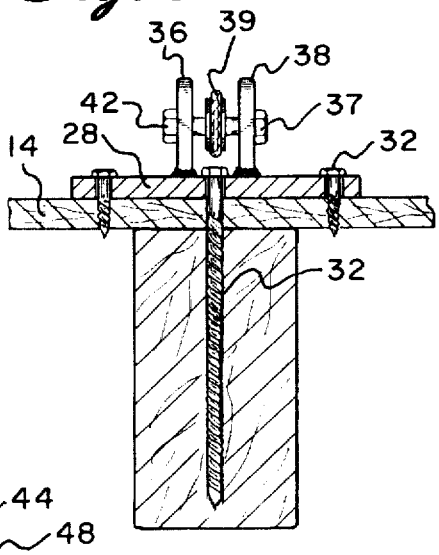
FIG. 8 is a cross-sectional view taken along lines 8—8 of FIG. 7.

A pair of partial side walls 36 and 38 extend upwardly from one end of the plate member 28. Each of the side walls has a hole formed therethrough. In the preferred embodiment, loop 39 extending from the end of cable 40 is positioned between the side walls 36 and 38. A bolt 42 extends through the hole in side wall 36, through the loop 39 that extends from the end of cable 40 and through the hole in side wall 38. The bolt 42 is then held in place by nut 37 threaded on to the bolt (see FIG. 8). Accordingly, one end of the cable 40 is secured to the plate member 28. The opposite end of the cable 40 has a loop 44 extending therefrom that is secured between side walls 46 and 48 that extend upwardly from the plate member 49 of roof anchor 18 (see FIGS. 7 and 9). Each of the side walls 46 and 48 has a hole formed therethrough and a bolt 50 is secured through the holes and the loop 44 in order to secure the two roof anchors 16 and 18 to one another. It should be noted that the two roof anchors can be secured to one another in a variety of other ways.

Figure 12:
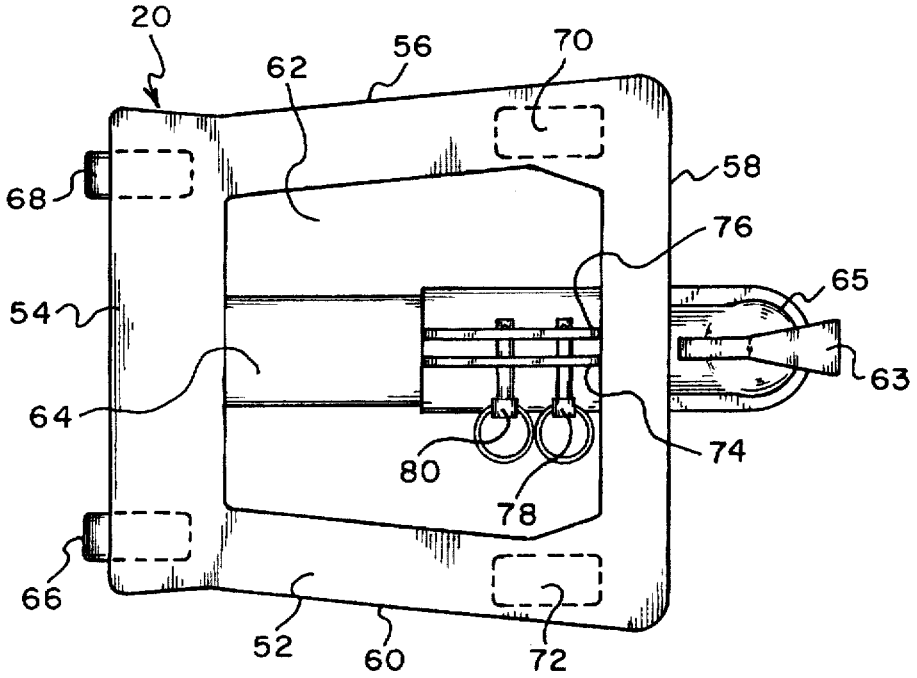
FIG. 12 is a top view of the base frame assembly and ball hitch roof anchor of FIG. 10.

The base frame assembly 20 of the winch assembly 12 is comprised of a frame 52 that has four encircling side walls 54, 56, 58 and 60 that define an opening 62 as best shown in FIG. 12. In the preferred embodiment, the side wall 54 is shorter than side wall 58. Side wall 58 is parallel to side wall 54 and is spaced therefrom by the side walls 56 and 60. The side walls 56 and 60 slightly diverge from opposing ends of side wall 54. Accordingly, the frame 52 has a trapezoidal shape.

Extending downwardly from the corners of the frame 52 are a plurality of wheel assemblies 66, 68, 70 and 72 (see FIG. 12). Each of the wheel assemblies can preferably rotate 360° its own axis and are placed on top of the roof frame 14.

The frame 52 is secured to the top of an elongated hitch element 64. The hitch element has a substantially hemispherical cavity or socket 65 formed in one end thereof. This socket is configured to be placed over the ball shaped member 34 which extends upwardly from the plate shaped member 28. When the cavity or socket is so placed, the base frame assembly 20 is secured to the roof anchor 16 and can freely rotate about the ball shaped member 34. The ball 34 and socket 65 are, per se, well known elements and function substantially as a ball and socket used with a vehicle trailer hitch. Preferably, the socket 65 is held onto the ball the ball 34 utilizing a locking means 63, also well known in the vehicle art.

The hitch element 64 preferably extends perpendicularly to side walls 54 and 58. A pair of angular side walls 74 and 76 extend upwardly from the hitch element 64 and through the opening 62 formed in the frame 52. The angular side walls 74 and 76 each have a pair of holes formed therethrough. Each hole in a side wall is aligned with a hole in the other side wall.

To facilitate an understanding of the principles associated with this embodiment of the invention, its operation will now be briefly described. The roof anchors 16 and 18 are positioned on opposite sides of the peak of a pitched roof 14 as illustrated in FIG. 7. The plate members 28 and 49 of each of the roof anchors are secured in place by threading screws 32 through corresponding screw holes 30 and into the roof 14 (see FIGS. 7–9).

The base frame assembly 20 is then mounted to the roof anchor 16. It should be noted that the assembly 20 can be mounted to the roof anchor 18 if the workman is working on the other side of the pitched roof. To mount the assembly 20 to the roof anchor 16, the substantially hemispherical cavity or socket 65 of hitch element 64 is placed over the ball shaped member 34 that extends upwardly from the plate member 28 of the roof anchor 16. The cavity has a diameter that is slightly larger than the diameter of the ball shaped member 34. Accordingly, the base frame assembly 20 can rotate about the ball shaped member. When the assembly 20 is so positioned, preferably only two wheels 66 and 68 contact the roof 14. The other two wheels 70 and 72 are slightly raised as shown in FIG. 11. This creates three points of contact with the roof. More specifically, the two wheels 66 and 68 and the hitch element 64 contact the roof since the assembly 20 is mounted to the ball shaped member which extends upwardly from the plate member 28.

The winch assembly 12 is then mounted to the base frame member in the following manner. The mounting plate 25 is positioned between the angular side walls 74 and 76. The mounting plate has a plurality of openings formed therethrough. Pins 78 and 80 are each inserted through a hole in side wall 74, through an opening in the mounting plate 25 and through a hole in side wall 76. The angle of the winch assembly 12 can be adjusted by inserting the pins through different openings formed through the mounting plate.

The snap hook 26 is then secured to the belt or harness of a workman so that he can safely perform the requisite work. Since the hemispherical cavity portion of the hitch element can freely rotate about the ball element and the wheels 66 and 68 are freely rotatable, as the workman moves to the left or right of the roof anchor 16, the base frame assembly via the two wheels and the roof anchor via the ball shaped member, create three points of contact with the roof frame so as to prevent the base frame assembly 20 frame tipping and thereby pulling screws 32 from the roof anchor when force is applied by the weight of the workman. In the event that the workman does fall when the winch assembly is rotated to one side or the other, the assembly may attempt to twist about the axis of the elongated hitch element 64. Should this occur, however, one of the remaining wheels 70 or 72 will contact the roof frame 14 so as to continue to provide a three point contact with the roof.

Figure 2:
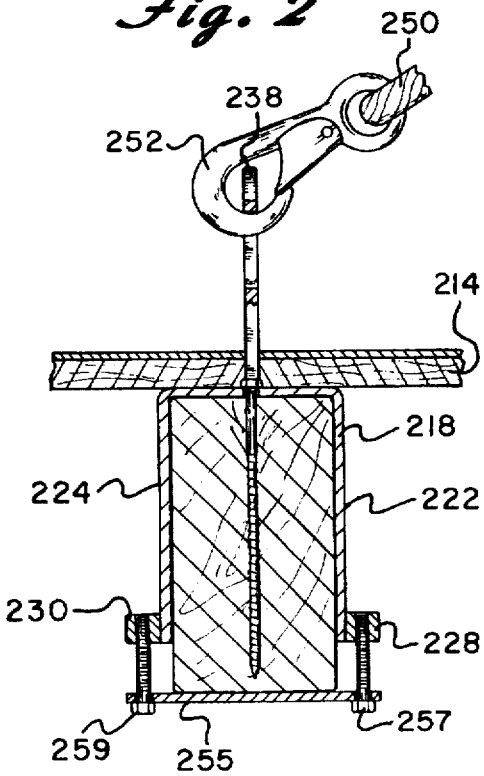
FIG. 2 is a cross-sectional view taken along lines 2—2 of FIG. 1.
Figure 3:
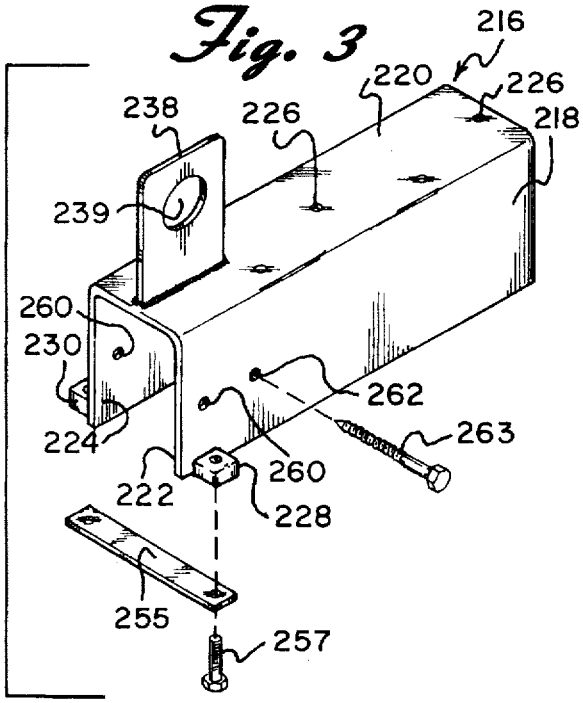
FIG. 3 is an exploded perspective view of the roof anchor of FIG. 1.

In the embodiment shown in FIGS. 1–3 an alternate roof anchoring system 210 is shown. This system includes a roof anchor 216 secured to a roof frame 214 and a safety line 250 that is adapted to be connected to the roof anchor. The roof frame 214 includes a joist 240 with opposing sides, a lower surface and an upper surface.

The roof anchor 216 includes a channel member 218. The channel member has an elongated upper section 220 and a pair of spaced apart opposing side walls 222 and 224 extending downwardly therefrom. The opposing side walls of the channel member are sized to engage the opposing sides of the joist 240 as more fully described below.

The elongated upper section 220 has a plurality of holes 226 formed therethrough. Each hole is preferably offset from adjacent holes. However, the holes can be aligned substantially along the same line. Flanges 228 and 230 extend outwardly from and are perpendicular to the lowermost portions of opposing side walls 222 and 224 of the channel member 218. Each of the flanges has a hole formed therethrough. The channel member is sized to fit over the joist 240 so that the opposing side walls 222 and 224 of the roof anchor 216 engage the opposing side walls of the joist. In the preferred embodiment, there is space between the bottom of the side walls 222 and 224 and the bottom of the joist (see FIG. 2).

A projection 238 extends upwardly from one end of the upper section 220 of the channel member 218. The projection has an eyelet 239 formed therethrough for enabling the connection of a safety line 250 thereto. More specifically, a snap hook 252 secured to one end of a safety line is hooked through the eyelet as shown in FIG. 2. The other end of the safety line is secured to the belt or harness of a workman as illustrated in FIG. 1.

A securing plate 255 has a hole formed adjacent each end thereof and is positioned along the bottom of the joist 240. In order to secure the roof anchor 216 to the joist, each hole in the securing plate 255 is aligned with a corresponding hole in each of the flanges 228 and 230. Thereafter, screws 257 and 259 are threaded through a corresponding hole in the securing plate and a corresponding hole in the flanges 228 and 230. To further secure the roof anchor 216 to the joist 240, two pairs of opposing side holes 260 and 262 are formed through the side walls 222 and 224. A screw 263 is inserted through each hole pair to secure the anchor to the joist 240.

It should be noted that the roof anchor 216 is preferably secured to the joist 240 before the roof frame 214 is applied. Accordingly, when the roof frame 214 and roof shingles are applied, projection 238 extends therethrough as shown in FIG. 1. This allows the roof anchoring system 210 to be available for later use for repairs or the like.

Figure 6:
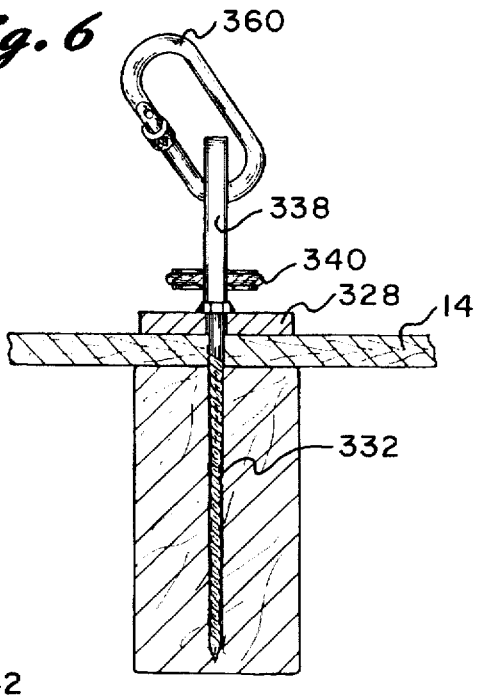
FIG. 6 is a cross-sectional view taken along lines 6—6 of FIG. 4.
Figure 5:
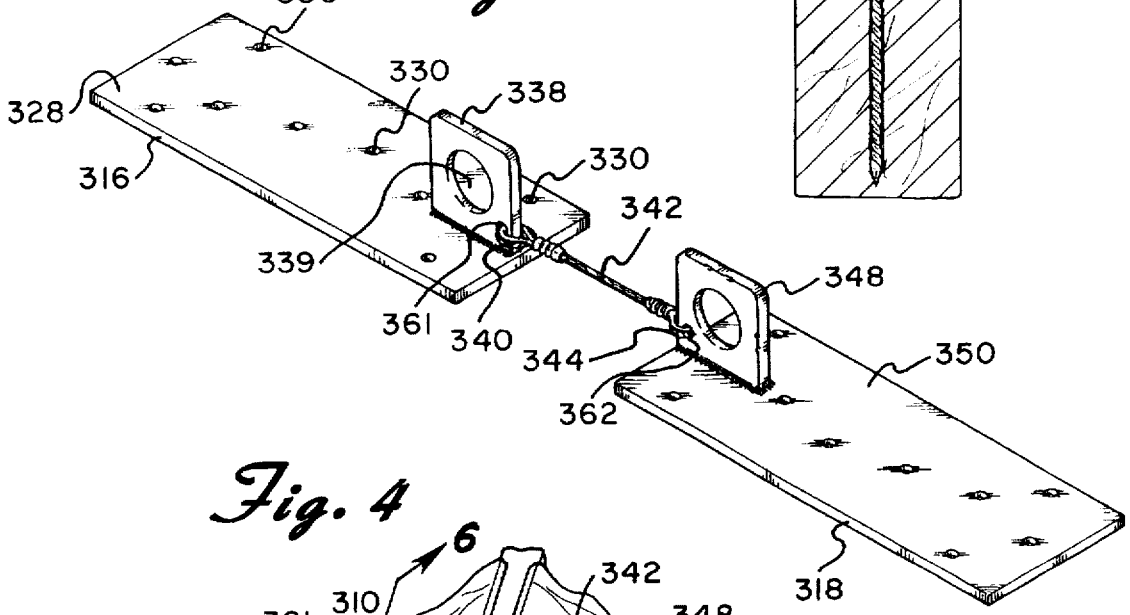
FIG. 5 is a perspective view of the roof anchors shown in FIG. 4.
Figure 4:
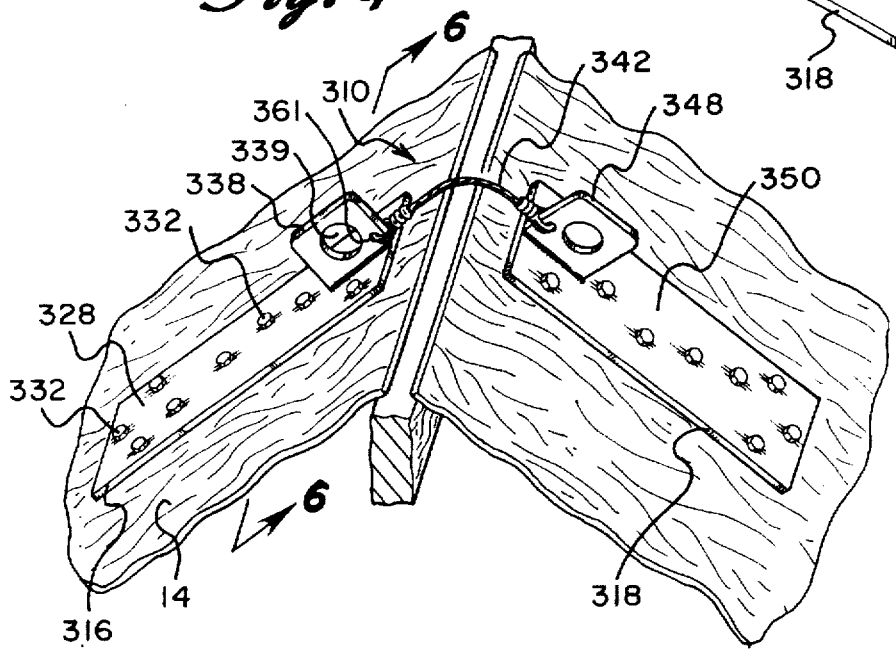
FIG. 4 is a perspective view of an alternate embodiment showing two connected roof anchors attached to a pitched roof.

FIGS. 4–6 disclose yet another roof anchoring system designated by the number 310. This roof anchoring system 310 includes two roof anchors 316 and 318. Each roof anchor is substantially identical to the other. Accordingly, only one of the anchors will be described in detail, it being understood that the description applies equally to the other roof anchor. The roof anchor 316 includes a plate member 328. The plate member is preferably made of stainless steel. However, it can be made of other metal alloys or other materials. The plate member 328 has a plurality of holes 330 formed therethrough (see FIG. 5). In order to secure the plate member 328 to the roof frame 14, a plurality of screws 332 are threaded through each of the holes 330 in the plate member 328 and into the roof frame.

A projection 338 extends upwardly from one end of the plate member 328. The projection 338 has an eyelet 339 formed therethrough. In the preferred embodiment, a loop 340 extends from one end of a cable 342 and is secured through a hole 361 formed through projection 338 adjacent eyelet 339. Similarly, loop 344 extends from the opposite end of cable 342 and is secured through a hole 362 formed through projection 348 which extends upwardly from plate member 350 of roof anchor 318.

In use, the roof anchors 316 and 318 are positioned on opposite sides of a pitched roof 14 as illustrated in FIG. 4. The plate members 328 and 350 of each of the roof anchors are secured in place bypassing screws 332 through corresponding holes 330 and threading them into the roof frame 14. Next, a snap hook 360 secured to one end of a safety line (not shown) is secured through the eyelet 339 (see FIG. 6). The other end of the safety line is secured to the belt or harness of a workman so that he can safely perform his work. Once the roofer has completed the work on the roof, the anchors 316 and 318 are removed from the same.

Figure 4A:
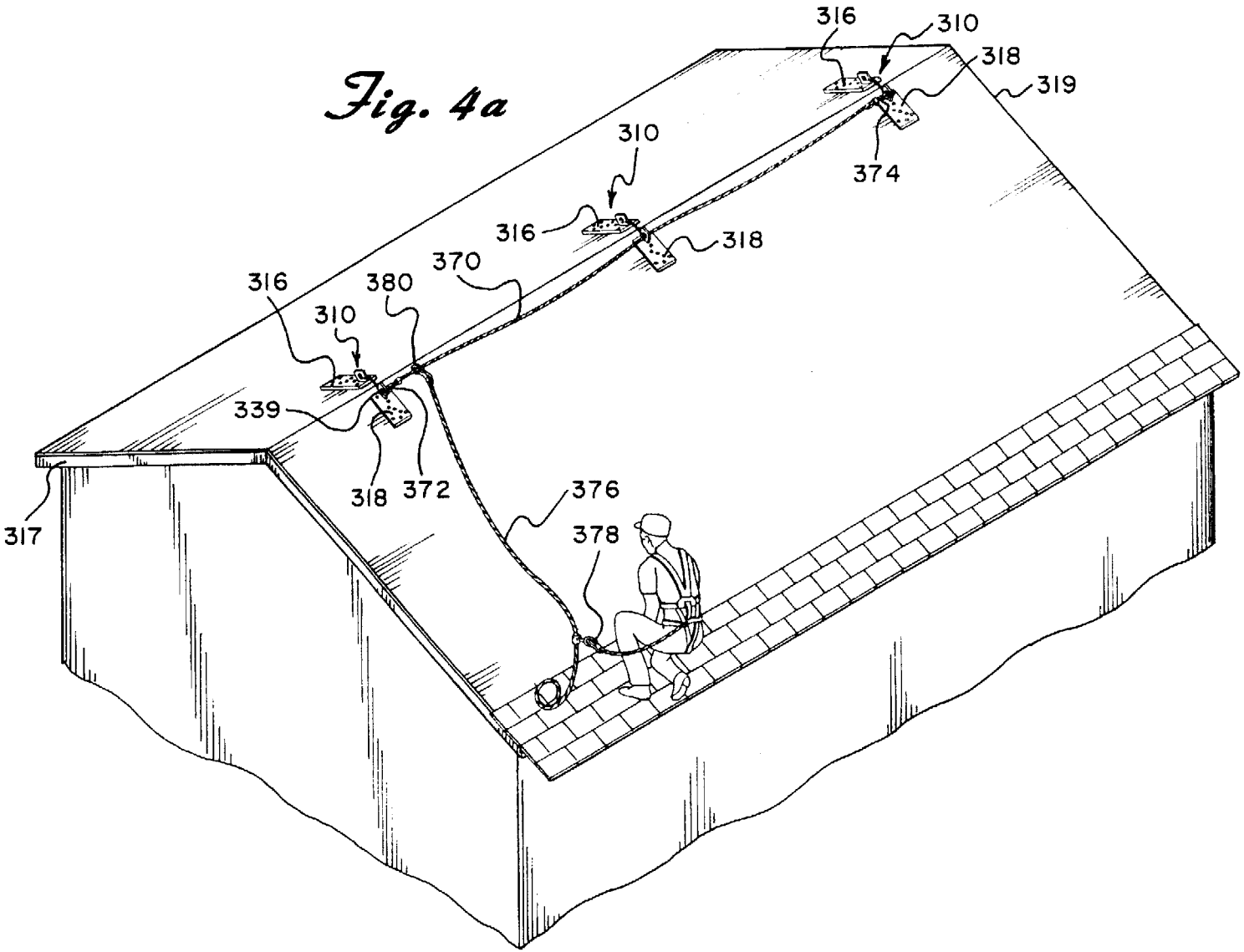
FIG. 4*a* is a perspective view of a roof structure showing a workman secured between separate connected pairs of roof anchors.

FIG. 4*a* discloses the use of a plurality of roof anchoring systems 310 of the type described above and shown in FIGS. 4 and 5. Secured through the eyelets 339 in each of the roof anchors 318 is a cord 370. More specifically, one end of the cord 370 is formed in a loop 372 around the eyelet in a roof anchor positioned near an end 317 of the roof. The cord is then positioned through the eyelet in the center roof anchor. Thereafter, the other end of the cord is formed in a loop 374 around the eyelet in the roof anchor located at an opposite end 319 of the roof.

In use, a workman secures one end of a line 376 to his harness by means of a snap hook 378. The other end of the line 376 is secured to the cord 370 between two roof anchors 318 by means of another snap hook 380. As the workman moves to the left or right, he can position the line 376 so that it is always substantially perpendicular to the cord 370. This is particularly advantageous in the event the workman falls from the roof since the occurrence of swing fall is prevented. It should be noted that a plurality of roof anchors of the type shown in FIGS. 1–3 and described above can be used instead of the roof anchors 318 if so desired.

The embodiment of FIG. 9*a* discloses an alternate roof anchor 116 that includes a plate shaped member 128. The plate shaped member 128 has a plurality of offset holes 130 formed therethrough. A ball shaped member 134 extends upwardly from the member 128. The ball shaped member is adapted to receive a base frame assembly similar to the base frame assembly 20 shown in FIGS. 10–12. The roof anchor 116 also has a pair of partial side walls 146 and 147 that extend upwardly from plate member 128. Each of the side walls has a hole 148 formed therethrough. A slotted opening 153 is formed through the plate member 128 between the side walls 146 and 147. The slotted opening allows this roof anchor to be placed over a roof anchor of the type shown in FIG. 5 and described above. More specifically, the slotted opening 153 of anchor 116 is placed over the projection 338 of roof anchor 316. A pin (not shown) may then be inserted through holes 148 in side walls 146 and 147 of anchor 116 and through the eyelet 339 in anchor 316. The embodiment 116 can also be used by itself by screwing it onto a roof in lieu of the embodiments of FIGS. 4–6 or to support a safety winch assembly 12.

The present invention may be embodied in other specific forms without departing from the spirit or essential attributes thereof and accordingly reference should be made to the appended claims rather than to the foregoing specification as indicating the scope of the invention.

What is claimed is:

1. In a roof anchoring system of the type including a roof anchor secured to a roof frame and a safety line adapted to be connected to said roof anchor, said roof frame including a joist with opposing sides, an upper surface and a lower surface, wherein the improvement comprises:

said roof anchor including a channel member, said channel member having an elongated upper section and a pair of spaced apart opposing side walls extending downwardly therefrom, said opposing side walls of said channel member being sized to engage said opposing sides of said joist, said elongated upper section having a plurality of holes formed therethrough;

a plurality of screws, a different one of said screws being associated with each of said holes for securing said upper section of said channel member to said upper surface of said joist;

means extending upwardly from one end of said upper section of said channel member for enabling the connection of said safety line thereto;

a pair of flanges, each of said flanges extending outwardly and perpendicularly from the bottom of a corresponding one of said opposing side walls of said channel member;

a securing plate being positioned adjacent the bottom of said joist, and means for connecting said securing plate to said flanges.

2. The system of claim 1 wherein said holes are aligned substantially along a line.

3. The system of claim 1 wherein said plurality of holes are offset from one another.

4. The system of claim 1 wherein said securing plate is positioned below and spaced from said flanges.

5. The system of claim 1 wherein said upwardly extending means includes a projection having an eyelet formed therethrough for engaging the safety line.

6. The system of claim 5 further including additional like roof anchors which are mounted at spaced apart locations on said roof along the same horizontal plane, each of said additional roof anchors including a channel member, each of said channel members having an elongated upper section and a pair of spaced apart opposing side walls extending downwardly therefrom, said opposing side walls of said channel member being sized to engage said opposing sides of the joist, each of said additional roof anchors including an upwardly extending projection having an eyelet formed therethrough for engaging the safety line.

7. The system of claim 6 further including a cord secured through each of said eyelets in said roof anchors, said safety line being adapted to engage said cord.

8. A roof anchoring system for securing to a roof frame comprising:

a winch assembly including a housing, a drum, a drum shaft; a safety line, and a centrifugal brake means, said drum and said drum shaft being rotatably mounted within said housing, said safety line being adapted to be wound around said drum and having one end secured thereto, the other end of said safety line being adapted to be connected to a workman, said centrifugal brake means being mounted within said housing for preventing rapid rotation of said drum and therefore rapid unwinding of said cable;

a roof anchor including a plate member;

means for securing said plate member to said roof frame;

a base frame assembly supporting said winch assembly thereon, said base frame assembly including wheel means rotatably mounted to and extending downwardly therefrom for contacting said roof frame, and hitch means connecting said base frame to said plate member, said hitch means allowing said base member to rotate relative to said plate member.

9. The roof anchoring system of claim 8 wherein said hitch means includes a ball shaped member extending upwardly from said plate member and a socket element extending from said base frame assembly, said socket element having a substantially hemispherical cavity formed in one end thereof engaging said ball shaped member.

10. The roof anchoring system of claim 9 wherein said base frame assembly includes a trapezoidal frame with four corners and said wheel means includes a plurality of wheels, each of said wheels rotatably mounted to and extending downwardly from a corresponding one of said corners.

11. The roof anchoring system of claim 9 wherein said base frame assembly includes a pair of parallel sides and a pair of non-parallel sides, said parallel sides are spaced from one another by said non-parallel sides.

12. The roof anchoring system of claim 11 wherein each of said non-parallel sides diverge from one of said parallel sides and wherein said parallel sides are perpendicular to said hitch means.

13. The roof anchoring system of claim 8 further including means for adjusting the angle of attachment of said winch assembly to said base frame assembly.

14. The roof anchoring system of claim 8 wherein said means for securing said plate member to said roof frame includes said plate member having a plurality of holes formed therethrough and a plurality of screws, each of said screws passing through a corresponding one of said holes and capable of being threaded into said roof frame.

15. A roof anchoring system comprising:

a roof frame;

a winch assembly including a housing, a drum, a drum shaft, a safety line, and a centrifugal brake means, said drum and said drum shaft being rotatably mounted within said housing, said safety line being adapted to be wound around said drum and having one end secured thereto, the other end of said safety line being adapted to be connected to a workman, said centrifugal brake means being mounted within said housing for preventing rapid rotation of said drum and therefore rapid unwinding of said cable;

a pair of roof anchors, each anchor including a plate member;

means for securing each of said plate members to said roof frame;

a base frame assembly for supporting said winch assembly thereon, said base frame assembly including wheel means rotatably mounted to and extending from the bottom thereof for contacting said roof frame;

hitch means connecting said base frame assembly to one of said plate members and allowing said base frame assembly to rotate relative said plate member, and means for connecting said roof anchors to one another.

16. The roof anchoring system of claim 15 wherein said hitch means includes a socket element extending from said base frame assembly and two ball shaped members, each of said ball shaped members extending upwardly from a corresponding one of said plate members, said socket element having a substantially hemispherical cavity formed in one end thereof and being placed over one of said ball shaped members.

17. The roof anchoring system of claim 16 wherein said means for securing each of said plate members to said roof frame includes each of said plate members having a plurality of holes formed therethrough and a plurality of screws, each of said screws passing through a corresponding one of said holes and being threaded into said roof frame.

18. The system of claim 15 wherein said connecting means includes a flexible cable having a first end and a second end, each end of said cable being secured to a corresponding one of said roof anchors.

* * * * *